US006547631B1

(12) United States Patent
Randall

(10) Patent No.: US 6,547,631 B1
(45) Date of Patent: Apr. 15, 2003

(54) PRAYER DOLL

(76) Inventor: Suzonne L. Randall, 477 Webster Ave., Uniondale, NY (US) 11553

( * ) Notice: Subject to any disclaimer, the term of this patent is extended or adjusted under 35 U.S.C. 154(b) by 0 days.

(21) Appl. No.: 09/709,198

(22) Filed: Nov. 10, 2000

(51) Int. Cl.[7] ..... A63H 3/28

(52) U.S. Cl. ..... 446/298; 446/175; 446/265; 446/330

(58) Field of Search ..... 446/175, 265, 446/268, 297, 298, 299, 300, 301, 303, 330, 337, 338, 376, 390, 391, 392, 395, 384, 343

(56) References Cited

U.S. PATENT DOCUMENTS

| | | | | | |
|---|---|---|---|---|---|
| 3,277,602 | A | * | 10/1966 | Speed et al. | 446/380 |
| 3,685,200 | A | * | 8/1972 | Noll | 446/299 |
| 4,186,517 | A | * | 2/1980 | Kuhn et al. | 446/330 |
| 4,571,206 | A | | 2/1986 | Mayer et al. | 446/330 |
| 4,571,208 | A | * | 2/1986 | Saigo et al. | 446/301 |
| D303,694 | S | | 9/1989 | Auricchio et al. | D21/177 |
| 4,867,729 | A | | 9/1989 | Weinman et al. | 446/330 |
| 4,923,428 | A | * | 5/1990 | Curran | 434/319 |
| 4,956,844 | A | * | 9/1990 | Miller, Jr. | 446/268 |
| D313,446 | S | | 1/1991 | Froutzis | D21/177 |
| 5,045,015 | A | * | 9/1991 | Arad et al. | 446/355 |
| 5,197,855 | A | | 3/1993 | Friedel | 434/236 |
| D353,634 | S | | 12/1994 | Walsh | D21/169 |
| 5,378,188 | A | * | 1/1995 | Clark | 446/330 |
| 5,456,625 | A | | 10/1995 | Dumond | 446/268 |
| 5,470,270 | A | | 11/1995 | Beamon, Jr. et al. | 446/354 |
| 5,588,895 | A | | 12/1996 | Larson | 446/98 |
| 5,607,336 | A | | 3/1997 | Lebensfeld et al. | 446/297 |
| 5,647,787 | A | | 7/1997 | Ravi et al. | 446/175 |
| 6,022,263 | A | * | 2/2000 | Liu et al. | 446/330 |
| 6,296,543 | B1 | * | 10/2001 | Andrews | 446/297 |

OTHER PUBLICATIONS

Humanoid look alikes in the form of robots have also been known.

* cited by examiner

*Primary Examiner*—Jacob K. Ackun
*Assistant Examiner*—Faye Francis
(74) *Attorney, Agent, or Firm*—Harvey Lunenfeld

(57) ABSTRACT

A prayer doll having a moveable head, limbs, and eyes, the moveable head, the limbs, and the eyes, pivotally mounted to the prayer doll, the other limbs, and the eyes; and a motion control system. The motion control system has: a motor and drive means, the motor driving the drive means, the drive means driving a plurality of cams, each of the cams driving a respective cam follower, each of the cam followers adjoined to a push pull cable atone end of the cable, each of the limbs, each the eyes, and the head adjoined to a respective opposing end of the cable, each of the cable imparting motion to the respective head, limb, eye. The prayer doll may also have an audio playback system.

25 Claims, 9 Drawing Sheets

3
24
28
20
30
34
36
6
14
7
15
8
16

PRAYER DOLL

BACKGROUND OF THE INVENTION

1. Field of the Invention

The present invention relates generally to dolls and more particularly to prayer dolls.

2. Background Art

Prayer is considered to be a devout request or petition to God, each religion having its own beliefs, approach to prayer, and the teaching of prayer to its disciples. Religious beliefs are most often passed on from parent to child with the educational process starting at home and then often carried on at a religious institution.

Although many major religions originate from the same basic beginnings and belief structures, these religions have taken different paths, with the resulting prayers, rituals, and approaches to prayer often differing significantly. As a result of these differences and the need for parents to educate their children, as well as adults interested in learning and/or reeducating themselves in their respective religions and learning about other religions, there is a need for a universal prayer teaching aid, which may be adapted to different religions. The teaching aid should be easy to use, inexpensive at all socioeconomic levels, programmable and adaptable for use in different religions, cultures, and languages, provide comfort to and be adaptable for use by children and adults, and capable of being carried by and used by a user at all times.

A user friendly teaching aid, which emulates and teaches prayer, provides a child with a warm and cuddly feeling, and which teaches and gives people of all ages a feeling of comfort, self esteem, and confidence in learning prayer is needed. A teaching aid which emulates and teaches prayer, may be carried with and used by the user at all times, and may also be used for play, is best suited to be in the form of a prayer doll. The prayer doll should be programmable and emulate the sounds, movements, and motions of prayer in the selected religions, and may optionally be provided with costumes and appearance of choice for the selected religion, culture, racial, and ethnic requirement. Both child and adult alike may mimic the movements and sounds of the prayer doll, during the learning process.

The prayer doll should offer the flexibility of demonstrating prayer in selectable religions, and emulate a plurality of sounds, movements, and motions, for different prayers in each of the selected religions. The prayer doll should be inexpensive, durable, programmable to emulate sounds, movements, and motions for different prayers in each of the selected religions, be adaptable and programmable for use in other religions, and be usable by a wide variety of cultures and in different languages.

The child and/or adult learning prayer from the prayer doll may mimic the sounds and movements of the prayer doll to effectively learn prayers and prayer techniques in the selected religion. Children often learn best during play. The prayer doll should be capable of being used for play, and may serve a plurality of purposes, offer a warm and cuddly feeling to children, and provide the confidence, self esteem, and comfort to people of all ages and children learning prayer. The prayer doll should provide the flexibility of selectably demonstrating prayer in selectable religions, and emulate a plurality of sounds, movements, and motions for different prayers that people of all ages may mimic as part of the learning process, provide the proper form and words of prayer, and encourage the child and/or adult to make prayer part of his or her daily routine There is thus a need for an inexpensive, durable, attractive, easy to use prayer doll that may be used as a teaching aid to demonstrate prayer in selectable religions, and emulate a plurality of sounds, motions, and movements for different prayers. The prayer doll should provide a feeling of comfort to people of all ages, emulate and teach prayer, provide a child with a warm and cuddly feeling, and provide people of all ages with a feeling of self esteem and confidence in learning prayer. The prayer doll should be usable and programmable for a plurality of prayers in different religions, different cultures and languages, and have different costumes and appearances, as required for different cultures, races, and ethnic requirements, and capable of being carried by and used by the user at all times. The prayer doll should be optionally voice activated.

Different dolls have heretofore been known. However, none of the dolls adequately satisfies these aforementioned needs.

Dolls with religious themes and winged figures have been disclosed.

U.S. Pat. No. 5,456,625 (Dumond) discloses a doll formed in the likeness of the Lord Jesus with a movable head and extremities comprised of a torso section, including a loin cloth molded into its lower portion and a pair of movable leg sections. U.S. Pat. No. 5,588,895 (Larson) discloses an angel action figure comprising a small adjustable mannequin provided with a wing assembly, a structure mounted against a back of the small adjustable mannequin for mounting the wing assembly, and a head mounted halo.

U.S. Pat. No. 4,571,206 (Mayer et al.) discloses an action figure which includes a torso having a pair of pivotally mounted wings and a pair of legs, the legs being mounted to the torso for both pivotal and rocking movement. A pair of actuating mechanisms within the torso converts the rocking movement to a pivotal movement, so that the wings are moved in a flapping manner. A spring returns the legs and wings to their normal or unactuated positions whenever the child stops pressing the legs together.

U.S. Pat. No. 4,867,729 (Weinman et al.) discloses an angel doll having movable wings that are hinged together. A mechanism is provided within the doll to impart movement to one of the wings, when the doll's head is pressed down. U.S. Pat. No. Des. 353,634 (Walsh) discloses an ornamental design of a Guardian Angel doll. U.S. Pat. No. Des. 303,694 (Auricchio et al.) discloses an educational toy doll. U.S. Pat. No. Des. 313,446 (Froutzis) discloses an ornamental design for a religious doll.

Sound controlled toys and sound producing toys have been disclosed.

U.S. Pat. No. 5,647,787 (Ravi, et al.) discloses a programmable sound controlled toy including a programmable toy activity driver assembly having a plurality of selectable activities, an audio receiver and a memory for receiving and storing a user determined and audio communicated sequence of activity commands, and a controller for causing the driver assembly to operate the toy in accordance with the user determined sequence of activity commands. The sound controlled toy has an audio receiver to intercept audio commands and an activity driver assembly, which selectively causes the action figure to take specific movement actions, as determined by received and decoded sound commands.

U.S. Pat. No. 5,197,855 (Friedel) discloses a therapeutic doll for self help having a speech-producing device to output encouraging messages.

U.S. Pat. No. 5,607,336 (Lebensfeld et al.) discloses a doll or action figure capable of delivering subject specific messages relating to one desired, precise subject, activity, profession, or area of interest for which the doll or action figure is dressed. The toy doll or action figure has an audio generator contained therein for producing audible messages, message containing components removably interconnectable therewith, and outfits of wearing apparel for designating or relating to one specific subject, activity, profession, or area of interest.

A movement producing toy having motions similar to certain portions of prayer motions has been disclosed.

U.S. Pat. No. 5,470,270 (Beamon, Jr. et al.) discloses a doll with baby hugging capabilities having a main body portion with a chest and with arms extending outwardly therefrom; a motion imparting mechanism within the doll having a horizontally disposed central plate, the plate having a forward end with a shield positionable in the chest area of the doll. The doll has a secondary plate positioned beneath the central plate, the secondary plate being adapted to move toward and away from the shield upon the application of forces to the rear surface of the secondary plate; and a pair of similarly shaped squeezer arms in an L-shaped configuration with short interior segments and long exterior segments positioned in the arms of the doll; first pivot pins securing the interior ends of the squeezer arms to the central plate adjacent to its rearward edges thereof for rotational movement with respect thereto.

Humanoid look alikes in the form of robots have also been known.

However, robotically based dolls that perform even limited functions have generally been expensive. For example, a "Barney" doll has been known, which demonstrates the state-of-the-art of combining the use of recorded sounds and word phrases with simple automated limb motion, under software control of an imbedded microcomputer has been known; however such a doll is considerably expensive. A low cost alternative is needed, that may be used and programmed, quickly, easily, and reliably for a specific religion, a plurality of prayers, specific languages, and cultures.

For the foregoing reasons, there is a need for an inexpensive, durable, attractive, easy to use, prayer doll that may be used as a teaching aid and for play, which emulates and teaches prayer to people of all ages, provides a child with a warm and cuddly feeling, and gives both adult and child a feeling of comfort, self esteem, and confidence in learning prayer. The prayer doll should be programmable and emulate a plurality of sounds, motions, and movements for a plurality of prayer in selected religions, selected languages, different cultures, and optionally provided with costumes and appearance of choice for the selected religion, culture, racial, and ethnic requirement, and capable of being carried by and used by the user at all times. Both child and adult alike may mimic the movements and sounds of the prayer doll, during the learning process. The prayer doll should be optionally voice activated.

SUMMARY

The present invention is directed to an inexpensive, durable, attractive, easy to use, prayer doll that may be used as a teaching aid and for play, which emulates and teaches prayer to people of all ages, provides a child with a warm and cuddly feeling, and gives both adult and child a feeling of comfort, self esteem, and confidence in learning prayer. The prayer doll is programmable and emulates a plurality of sounds, motions, and movements for a plurality of prayers in selected religions, selected languages, different cultures, and is optionally provided with costumes and appearance of choice for the selected religion, culture, racial, and ethnic requirement, and is capable of being carried by and used by the user at all times. Both child and adult alike may mimic the movements and sounds of the prayer doll, during the learning process. The prayer doll may be optionally voice activated.

A prayer doll having features of the present invention comprises: a doll having moveable head, limbs, and eyes, the moveable head, the limbs, and the eyes, pivotally mounted to the prayer doll, the other limbs, and the eyes; and a motion control system, the motion control system having: a motor and drive means, the motor driving the drive means, the drive means driving a plurality of cams, each of the cams driving a respective cam follower, each of the cam followers adjoined to a push pull cable at one end of the cable, each of the limbs, each the eyes, and the head adjoined to a respective opposing end of the cable, each of the cable imparting motion to the respective head, limb, eye. The prayer doll may also have an audio playback system.

DRAWINGS

These and other features, aspects, and advantages of the present invention will become better understood with regard to the following description, appended claims, and accompanying drawings where:

Figure 8B:
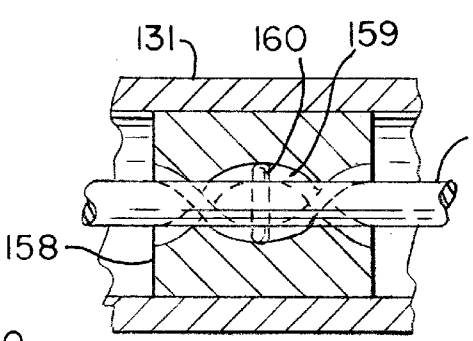
Figure 8A:
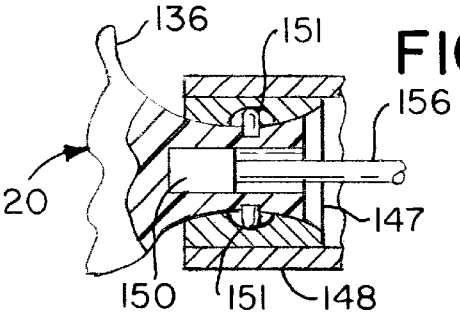
Figure 8:
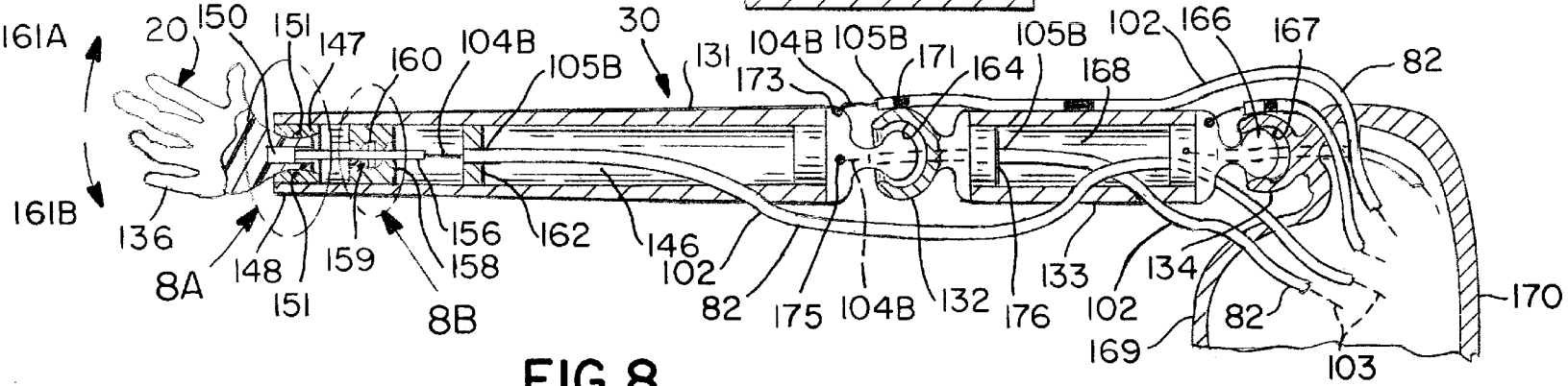
Figure 9:
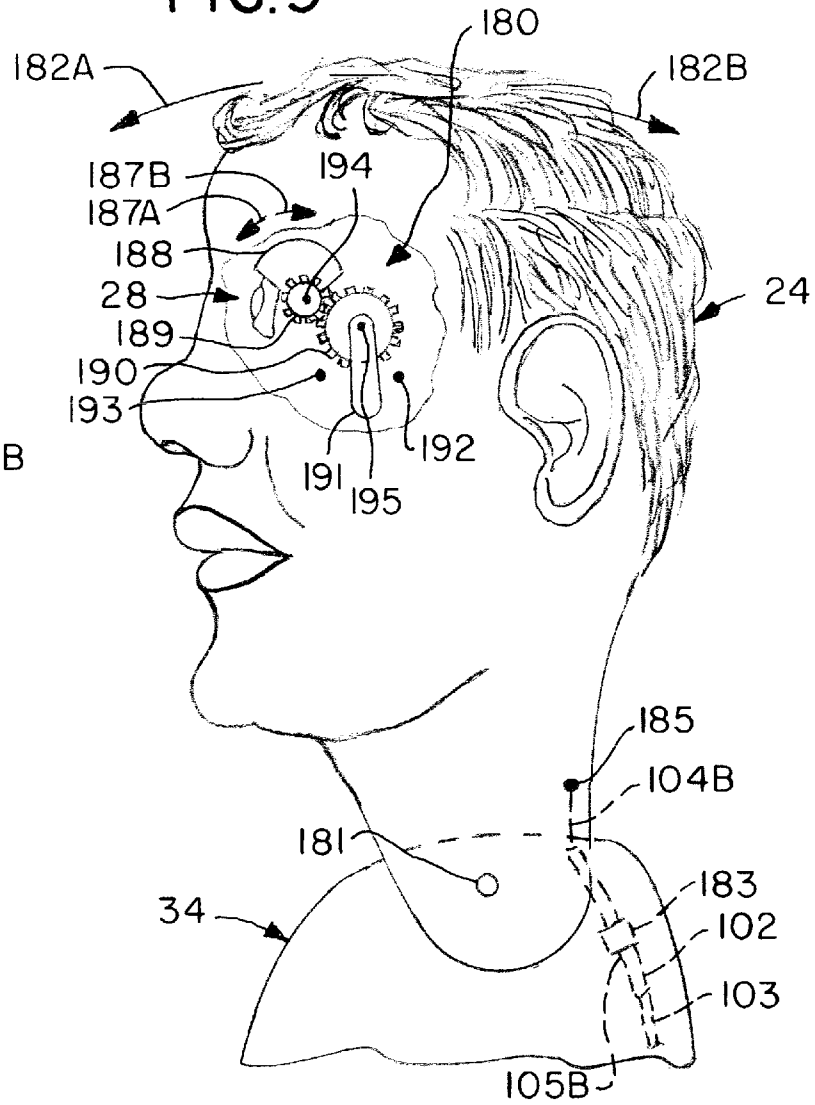
Figure 10:
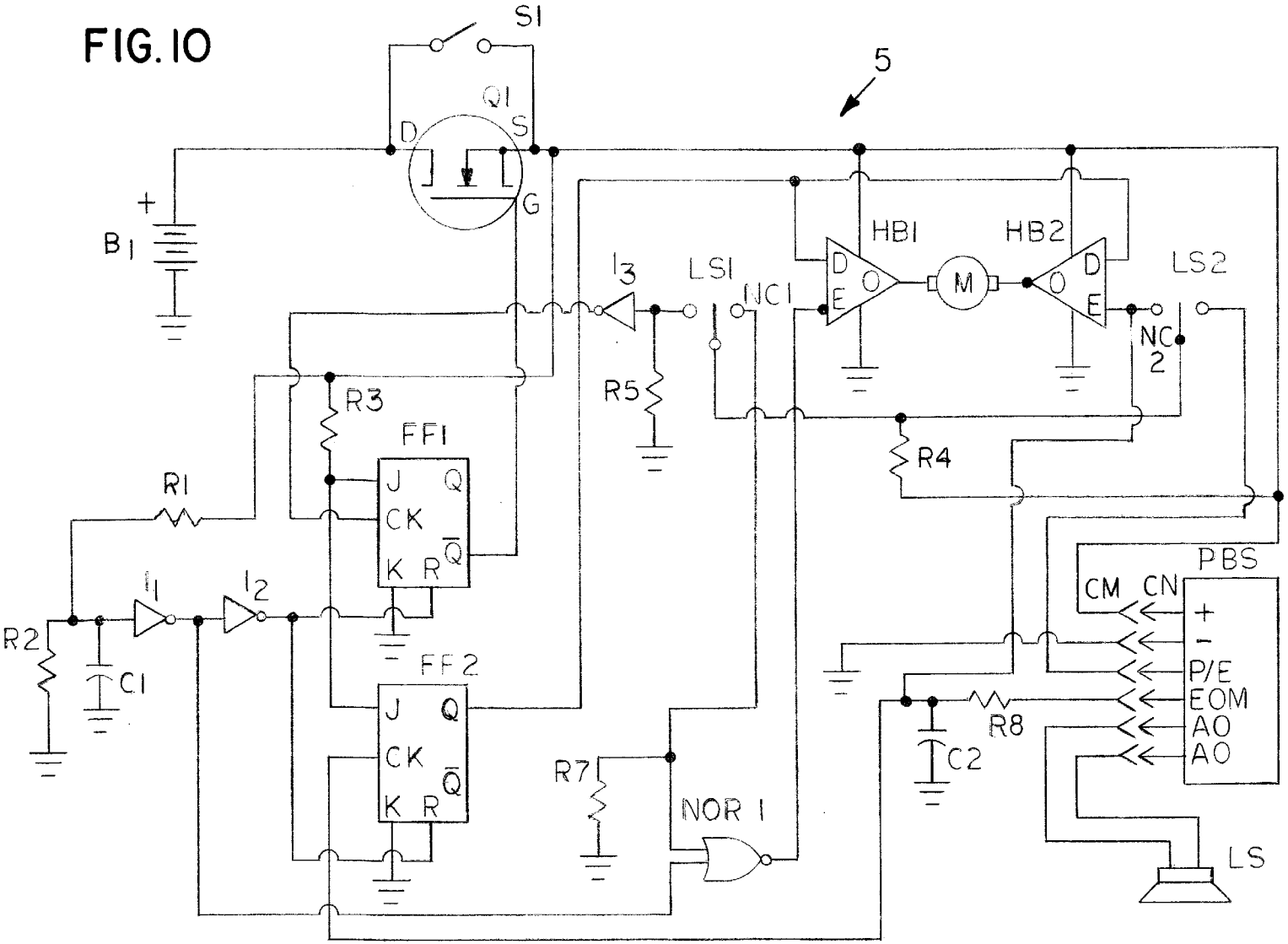
Figure 11A:
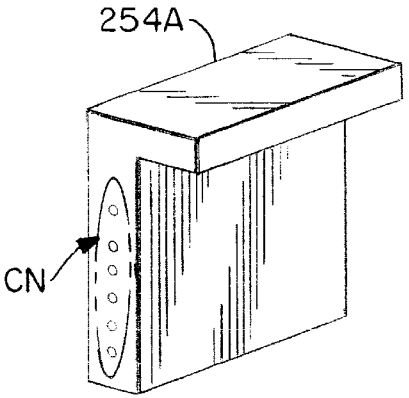
Figure 11B:
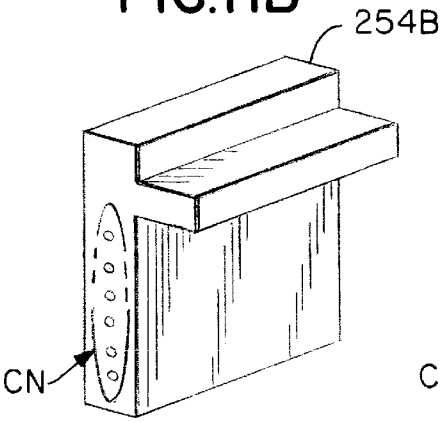
Figure 11C:
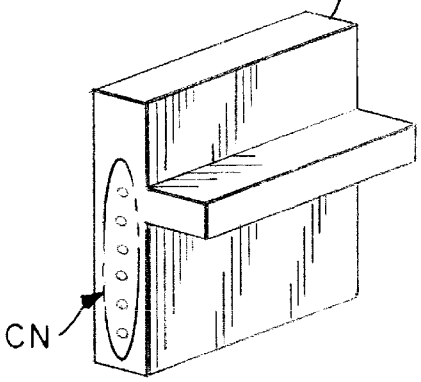
Figure 11D:
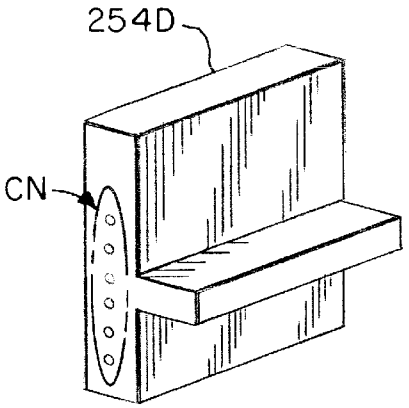
Figure 11E:
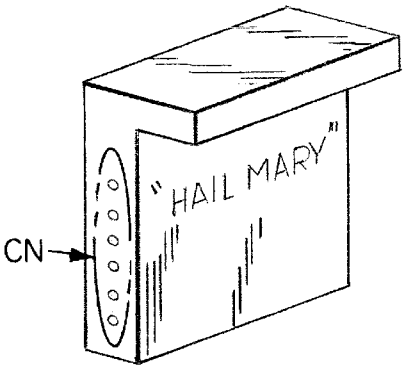
Figures 12, 13:
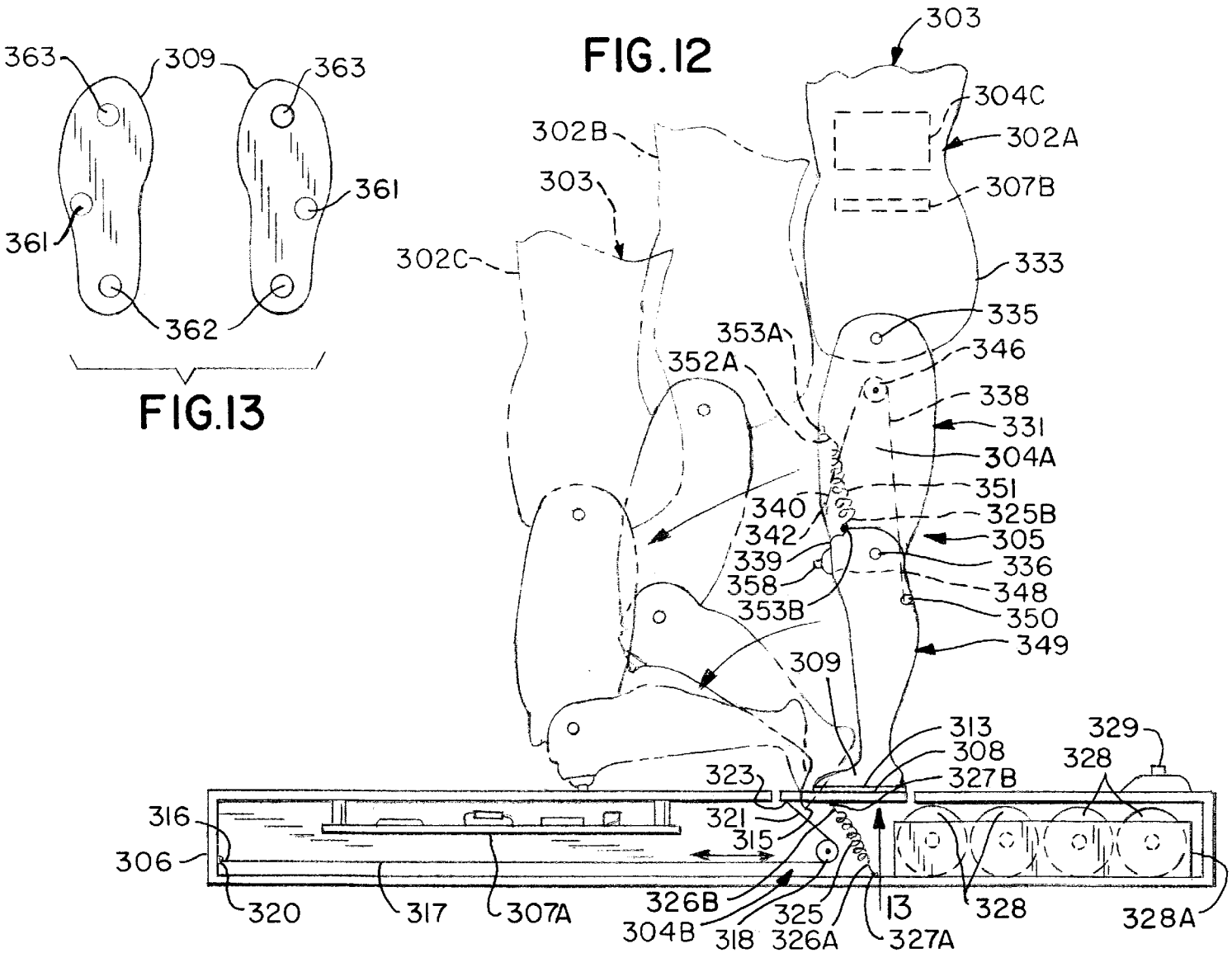

FIGS. 8, 8A, and 8B are side views of hand/arm/shoulder joints of an arm of the prayer doll and portions thereof;

FIG. 9 is a side view of a head and breakout view of an eyelid mechanism of the prayer doll;

FIG. 10 is a schematic diagram of an electronics system of the prayer doll;

FIG. 11A is a perspective view of a prayer module of the prayer doll;

FIG. 11B is a perspective view of an alternate prayer module of the prayer doll;

FIG. 11C is a perspective view of another alternate prayer module of the prayer doll;

FIG. 11D is a perspective view of another alternate prayer module of the prayer doll;

FIG. 11E is a perspective view of another alternate prayer module of the prayer doll;

FIG. 12 is a side view of an alternate embodiment of a prayer doll, constructed in accordance with the present invention, shown in standing, intermediate, and kneeling positions with optional base mechanism;

FIG. 13 is a bottom view of feet of the prayer doll of FIG. 12; and

Figure 14:
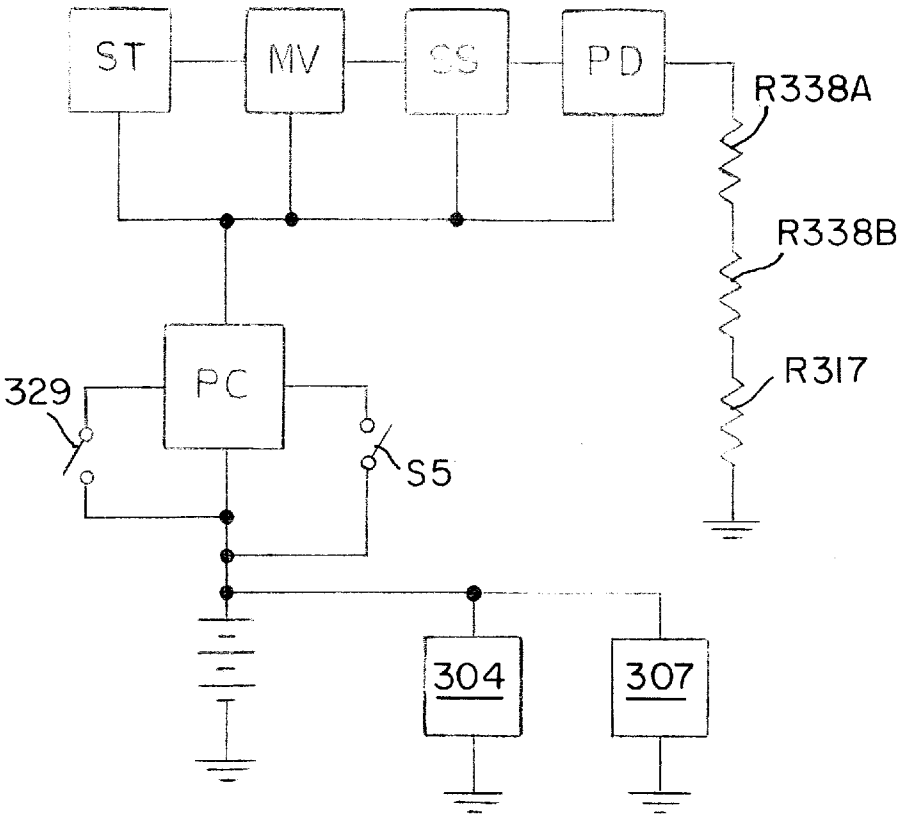

FIG. 14 is a block diagram of a base electronics system portion of an electronics system of the prayer doll of FIG. 12.

DESCRIPTION

The preferred embodiments of the present invention will be described with reference to FIGS. 1–12 of the drawings. Identical elements in the various figures are identified with the same reference numbers.

Figure 1:
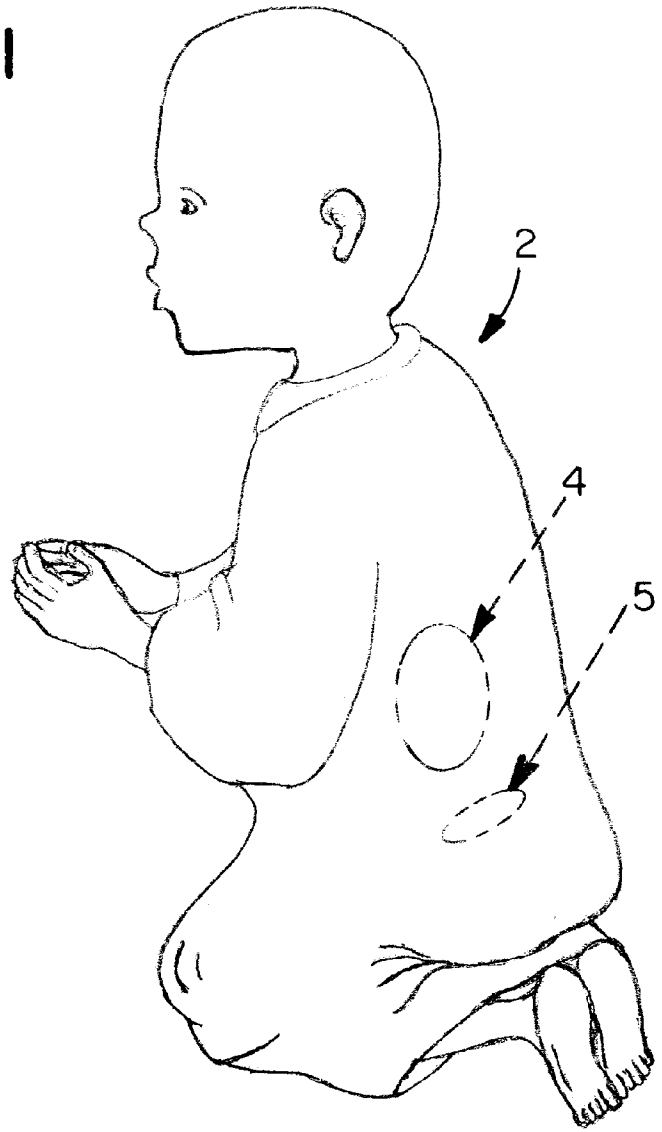
FIG. 1 is a perspective view of a prayer doll, constructed in accordance with the present invention.

FIG. 1 shows a prayer doll 2, constructed in accordance with the present invention, having a doll 3 having moveable body parts, a motion control system 4, and an 10 electronics system 5.

Figures 2A, 2B, 3A, 3B, 4A, 4B:
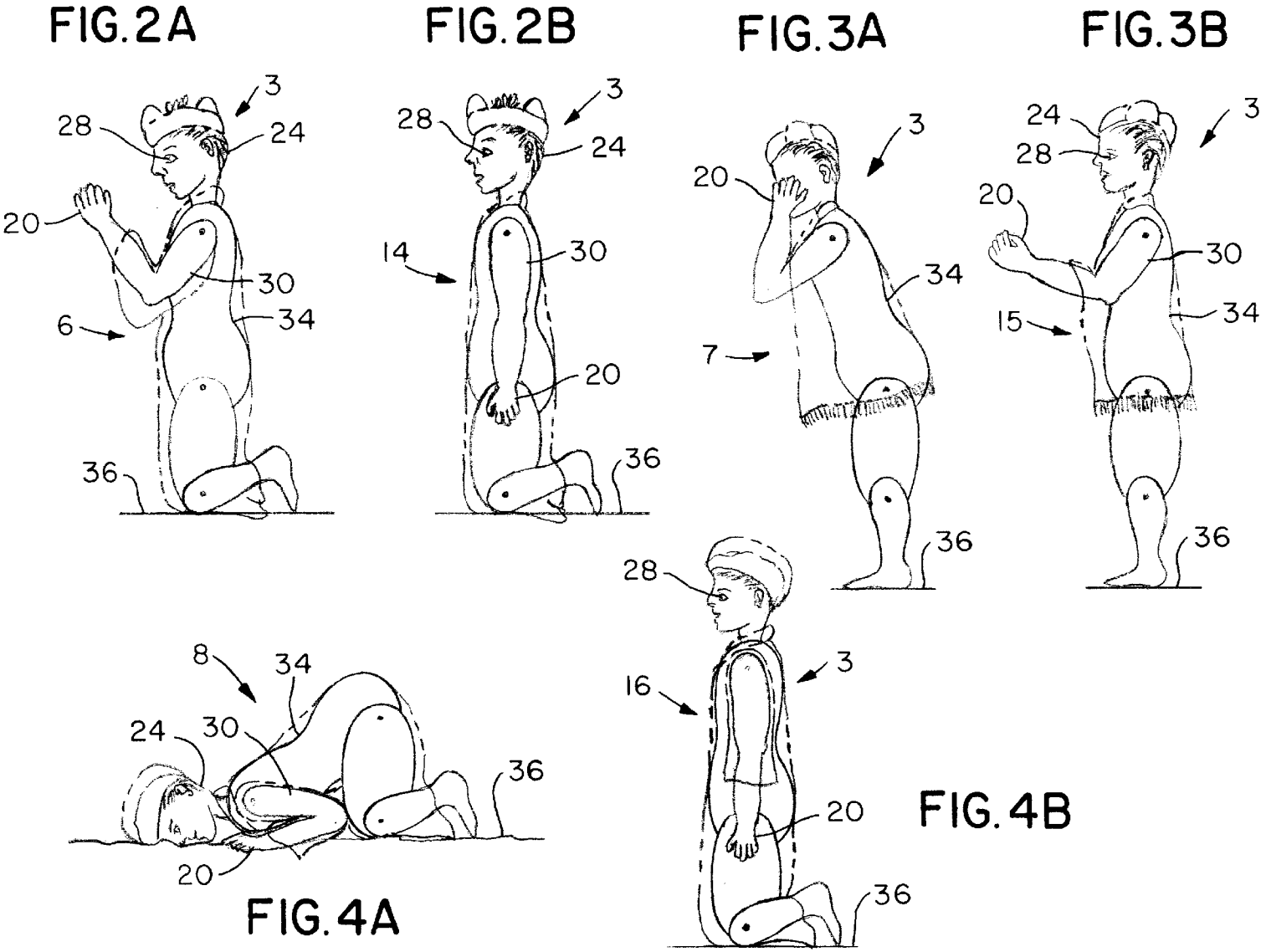
FIG. 2A is a side view of a prayer doll, in a Christian prayer posture.
FIG. 2B is a side view of the prayer doll of FIG. 2A in a Christian prayer starting posture.
FIG. 3A is a side view of the prayer doll in a Jewish prayer posture.
FIG. 3B is a side view of the prayer doll of FIG. 3A in a Jewish prayer starting posture.
FIG. 4A is a side view of the prayer doll in a Moslem prayer posture.
FIG. 4B is a side view of the prayer doll of FIG. 4A in a Moslem prayer starting posture.

FIGS. 2A, 3A, and 4A show side views of the doll 3 in selected Christian, Jewish, and Moslem prayer postures 7, 8, and 9, respectively, which are representative of the Christian, Jewish, Moslem, and other major religious traditions. FIGS. 1B, 2B, and 3C show the doll 3 in starting postures 14, 15, and 16, for the Christian, Jewish, and Moslem religious traditions, respectively.

The Christian prayer posture 6 of FIG. 2A shows the doll 3 praying while in a kneeling position, with the doll 3 having hands 20 raised and together, head 24 bowed, and eyes 28 closed. The doll 3 enters the Christian prayer posture 6 and initiates prayer motion starting from the Christian starting posture 14, having the head 24 upright, the eyes 28 open, the hands 20 and arms 30 alongside torso 34.

The Jewish prayer posture 7 of FIG. 3A shows the doll 3 in a standing while praying position, having the torso 34 bowed, the hands 20 raised to and covering the eyes 28, the arms 30 raised, the head 24 bowed, and the eyes 28 closed. The doll 3 enters the Jewish prayer posture 7 from and with prayer motion initiated from the Jewish starting posture 15, with the doll 3 having the head 24 upright, the hands 20 and the arms 30 partially raised from the torso 34.

The Moslem prayer posture 8 of FIG. 4A shows the doll 3 in a semi prostrate while praying position, the doll 3 having the torso 34 bent forward and down, the head 24 and the hands 20 touching floor 36. The Moslem posture 8 is entered from and with prayer motion started from the Moslem starting posture 16, with the doll 3 having the head 24 upright, the eyes 28 open, the hands 20 and the arms 30 alongside the torso 34.

The prayer doll 2 may be used to teach prayer and emulate a variety of prayer postures, motions, and audio prayer for the Christian, Jewish, and Moslem religions, as in the Christian, Jewish, and Moslem prayer postures 6, 7, and 8, respectively, and other religions of the world. Each of the above postures motions, and audio prayers, which start from entry postures, as in the Christian, Jewish, and Moslem starting postures 14, 15, and 16, respectively, and end in the final Christian, Jewish, and Moslem prayer postures 6, 7, and 8, respectively, are only representative of a selected variety of prayer and praying motions for each of the respective religions from a much larger repertoire that the prayer doll 2 may teach and emulate. The repertoire of prayer postures, praying motions, and audio motions of the prayer doll 2 may be selectively programmed into the electronics system 12 of the prayer doll 2 of the present invention at the time of manufacture or by the user.

As there is a need for the prayer doll 2 to be inexpensive and affordable to all socioeconomic groups and accurately represent the religious postures and motions desired in a smooth "non-robotic" action with minimal noise, actions of the prayer doll 2 of the present invention have been reduced to: a "setup action" beginning at the start of the prayer; delivery of an audio prayer message; and a "return action" at the end of the prayer. The setup action and the return action are not dependent on the audio prayer message, except to start the audio prayer message and to start the return action at the end of the prayer. Attention is focused on words of the audio prayer message, while simplifying control requirements.

FIGS. 5–9 show the motion control system 4 of the prayer doll 2 of the present invention, which is driven by a single inexpensive miniature motor 81. The motion control system 4 is capable of imparting simultaneous smooth motion to several body and limb joints in compound directions, which may be factory programmed to establish a repertoire of desired prayer motions. The user may select prayers and selected prayer motions from the factory programmed repertoire of prayers, or the user may insert a preprogrammed prom (not shown) with an alternate or supplementary repertoire of prayers into an appropriate slot (not shown) in the prayer doll and plug the preprogrammed prom into a printed circuit of the electronics system 4. The miniature motor 81, which may be a toy motor, may be sound insulated from other portions of the prayer doll 2 by judicious use of sound absorbing material in the vicinity of the miniature motor 81.

Figure 6:
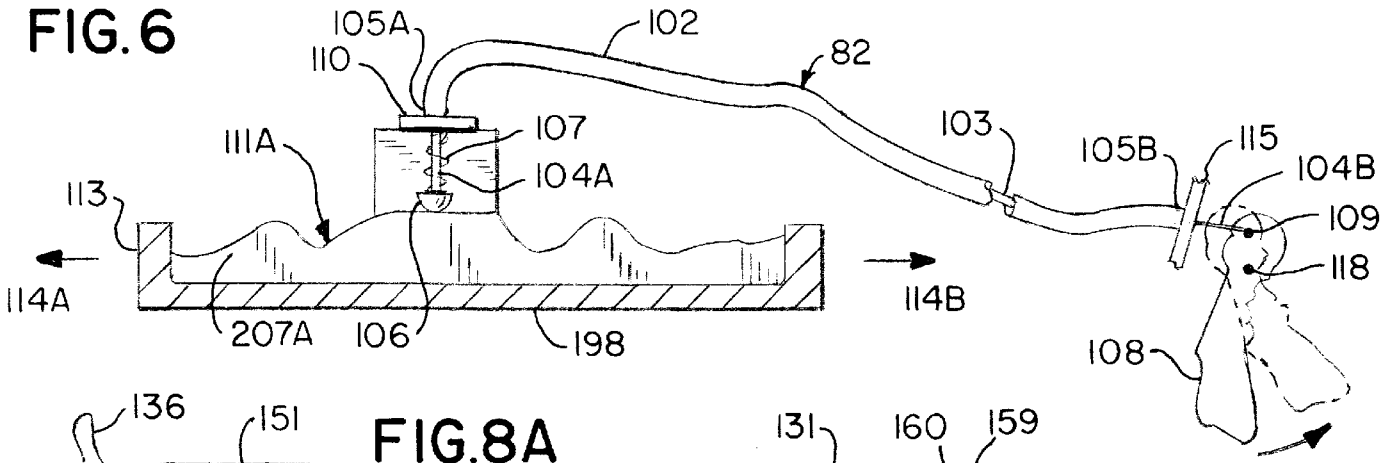
FIG. 6 is a view side of a linear cam/cable of the prayer doll.

The motion control system 4 of the prayer doll 2 is a self regulating mechanism, based upon the of use sub-miniature push-pull cables 82, each of the respective push-pull cables 82 having a flexible hollow housing 102, as shown in FIG. 6, with a flexible push-pull cable core 103 of resilient wire line within the flexible hollow housing 102. The flexible push-pull cable core 103 has proximal and distal ends 104A and 104B, respectively, and the sub-miniature push-pull cables 82 of the flexible hollow housing 102 has proximal and distal ends 105A and 105B, respectively, which may be guided around obstacles, are rigidly anchored to internal portions of the doll 3. A knob 106 is affixed to the proximal end 104A of the flexible push-pull cable core 103, and a biasing spring 107 surrounds the proximal end 104A of the flexible push-pull cable core 103. The knob 106 and the biasing spring 107 push and pull the flexible push-pull cable core 103, respectively, which then push and pull an actuator 108, pivoted at pivot point 109, at the distal end 104B of the flexible push-pull cable core 103, respectively. The actuator 108 abuts a selected moveable limb or other moveable body part, which moves in conjunction with the actuator 108.

Industrial push-pull cables, which have spiral housings and cores of tempered wire, have significant friction between the cores and the spiral housings and require large bending radii. A subminiature flexible push-pull cable having a low coefficient of friction between the core and the interior of the housing can be constructed of a housing of plastic tubing and a core of monofilament nylon line. The housing of fluoropolymer (i.e. Teflon) tubing or polypropylene tubing has a low coefficient of friction with respect to the nylon monofilament line.

Figures 5, 5A:
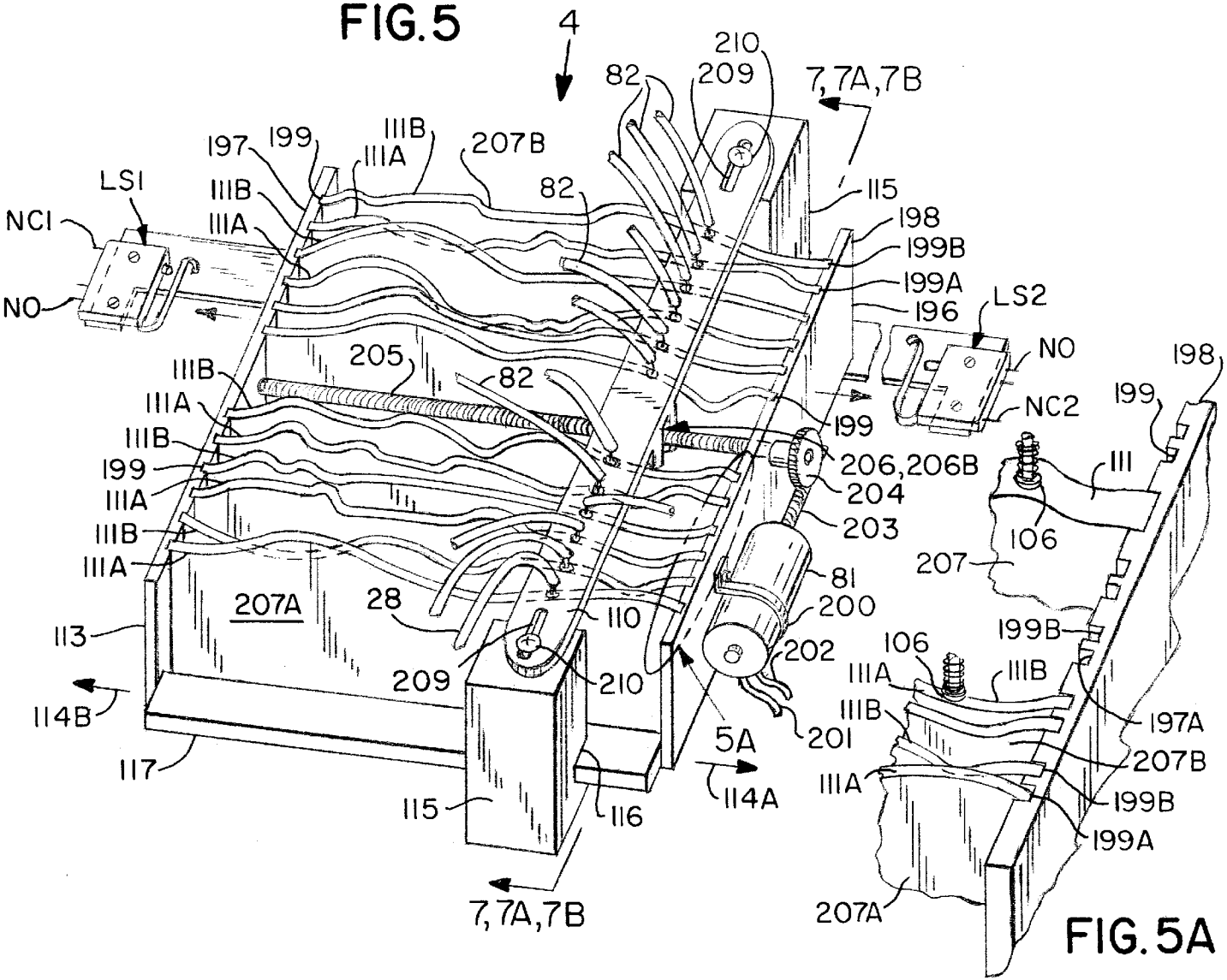
FIG. 5 is a perspective view of a motion control system of the prayer doll.
FIG. 5A is a perspective break out view of a portion of the motion control system of FIG. 5.

The flexible subminiature push-pull cable 82 is affixed to cable frame 110, as shown in FIGS. 5–7, at the proximal end 105A of the flexible hollow housing 102 with the knob 106 biased abuttingly against cam profile 111 (not shown in FIG. 6) and against either cam profile 111A, as shown in FIG. 6, or cam profile 111B (not shown in FIG. 6), creating a cam follower 112, as cam tray 113 is moved laterally in directions 114A and 114B, respectively. The knob 106 is biased abuttingly against the cam profile 111A, as the cam tray 113 is moved laterally in the direction 114A, and the knob 106 is biased abuttingly against the cam profile 111B, as the cam tray 113 is moved laterally in the direction 114B. The distal end 105B of the flexible housing 102 is then affixed to a portion of the doll structure (not shown) in the vicinity of a joint (e.g.—ball joint or pivot), enabling the flexible push-pull cable 103 core to actuate another part of the doll, such as a limb (not shown). A different one of the knobs 106 is biased abuttingly against the cam profile 111, which will be described in more detail later, as the cam tray 113 is moved laterally in the directions 114A and 114B.

Now in more detail, as shown in FIGS. 5–7, the distal end 104B of the flexible push-pull cable core 103 is affixed to the actuator 108, which is pivoted at the pivot 109. The cable frame 110 is loosely fastened to track blocks 115 having receiving tracks 116. The cam tray 113 has track rails 117 mating with and moving within the receiving tracks 116 in the directions 114A and 114B. The knob 106 can then be made to contact any point on either the cam profiles 111A and 111B, or the cam profile 111, depending on the location of the cam tray 113 with respect to the cable frame 110. In particular, as the cable frame 110 and the cam profiles 111A, 111B, and 111 move in the directions 114A and 114B, the knob 106 abuttingly contacts either the cam profile 111A or 111B, and another of the knobs 106 abuttingly contacts the cam profile 111, the biasing spring 107 pulls the flexible push-pull cable core 103, thus pulling the distal end 104B of the flexible push-pull cable 103, causing the actuator 108 to pivot at the pivot 109, and the limb (not shown), which is affixed to or contacts the actuator 108, to pivot about the pivot 109.

A plurality of the flexible hollow housings 102 of the push-pull cables 82 may be affixed to the cable frame 110 and a plurality of the cam profiles 111, 111A and 111B may be placed in and affixed to the cam tray 113, as shown in FIGS. 5 and 7. By moving the cam tray 113 from laterally from side to side, as in the directions 114A and 114B, (for example, from right to left or from left to right) at substantially constant speed, limbs and/or joints can be actuated and moved at different speeds and directions simultaneously, substantially anywhere on the doll 3.

Now in more detail, FIG. 8 shows the hand 20, forearm 131, elbow 132, upper arm 133, and shoulder joint 134 of the doll 3. By using, for example, a plurality of the push-pull cables 82, each associated with a pair of the selected cam profiles 111A and 111B and one of the cam profiles 111, which are shaped for selected limb motions and speeds, the hand 20 can move curvilinearly, the forearm 131 and the upper arm 133 can each move laterally as well as up and down, with the combined motion of apparent limb rotation, and other body parts can simultaneously move with controlled motion. In this case, five push-pull cables 82, each associated with a pair of the selected cam profiles 111A and 111B are used for curvilinear motion of the hand 20, with the forearm 131 and the upper arm 133 each selectively moving laterally, as well as up and down, with the combined motion of limb rotation The hand 20 can be molded with fingers 136 together, although the fingers 136 are shown separated for clarity. Wrist 137 can be flexible, such that the hands 20 matingly fit one to the other when the hands 20 are abutted one to the other. The forearm 131 has hollow portion 146 and collar 147, which is affixed to end 148 of the forearm 131, the collar 147 having grooves 149. The hand 20 has a recess 150 and two hemispherical nibs 151 mating with the grooves 149 of the collar 147 within the wrist 137. The nibs 151 snap into the grooves 149 of the collar 147, which may be bonded to the end 148 of the forearm 131, and retain the hand 20 within the end 148 of the forearm 131, while permitting curvilinear motion of the hand 20. A square cross section drive bar 156 is affixed to the hand 20 within hand recess 157. The hand 20 is moved curvilinearly by reciprocating the drive bar 156 within block 158. The block 158 has spiral groove track 159, which is engaged by mating molded nibs 160 on the drive bar 156. The drive bar 156 is reciprocated and the mating molded nibs 160 ride within the spiral groove track 159 and impart curvilinear motion to the hand 20, as indicated by directions 161A and 161B. The drive bar 156 is actuated by the flexible push-pull cable core 103 core of the flexible subminiature push-pull cable 82. The proximal end 104 of the flexible hollow housing 102 is affixed to plate 162 affixed internally to the forearm 131. Curvilinear motion is imparted to the hand 20 in the directions 161A and 161B, by reciprocating the flexible push-pull cable core 103 through remote cam action, as the cam tray 113 having the track rails 117 mating with and moving within the receiving tracks 116 is moved laterally in the directions 114A and 114B.

Ball and socket joints 163 and 164, respectively, at the elbow 132, rotationally adjoin the forearm 131 to the upper arm 133. Ball and socket joints 166 and 167, respectively, at the shoulder joint 134, rotationally adjoin the upper arm 133 having hollow portion 168 to the shoulder joint 134.

Torso front 169 and torso back 170 are also shown in FIG. 8. Flexible subminiature push-pull cables 82 affixed to the cable frame 110 and to the upper arm 133 operate the elbow 132 in lateral and up/down or orthogonal directions, by remote cam action. The distal end 105B of the flexible hollow housing 102 is, for example, affixed to the upper arm 133 at connection point 171, the distal end 104B of the flexible push-pull cable core 103 is affixed to the forearm 131 at connection point 173, and the proximal end 105A of the flexible hollow housing 102 is affixed to the cable frame 110. The knob 106 is affixed to the proximal end 104A of the flexible push-pull cable core 103, and is biased abuttingly against either the cam profile 111A or 111B by the biasing spring 107, imparting motion to the forearm 131 through the flexible push-pull cable core 103, as the knob 106 moves abuttingly against either the cam profile 111A or 111B, and as the cam tray 113 moves laterally in either the direction 114A or 114B, respectively. The distal end 104B of the flexible push-pull cable core 103 affixed to the forearm 131 at point 173 is used to impart lateral motion to the forearm 131, while another distal end 104B of yet another flexible push-pull cable core 103 affixed internally to the forearm 131 at point 175 with the distal end 105B of yet the other flexible hollow housing 102 affixed internally to the upper arm 133 at connection point 176 is used to impart up/down or orthogonal motion to the forearm 131 at the elbow 132.

Controlled motion is imparted to the upper arm 133 in substantially the same manner as motion is imparted to the forearm 131. Other limbs of the doll 3 can also be imparted motion in substantially the same manner, and while there may be some small unintended interaction between motions of the limbs, the desired motion can still be programmed by careful attention to cam profile design.

The sub-miniature push-pull cables 82 are threaded through access holes in various portions of the doll 3. In cases where cables might be exposed, the sub-miniature push-pull cables 82 are hidden by loose fabric doll clothing.

Figure 7B:
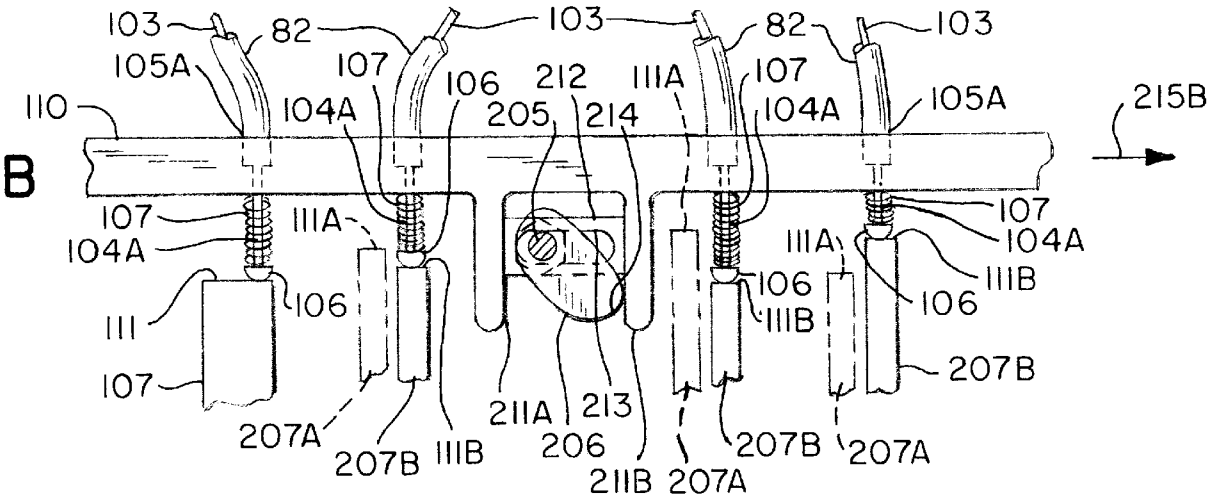
FIG. 7B is another end section view of the portion of the motion control system of FIG. 5.
Figure 7A:
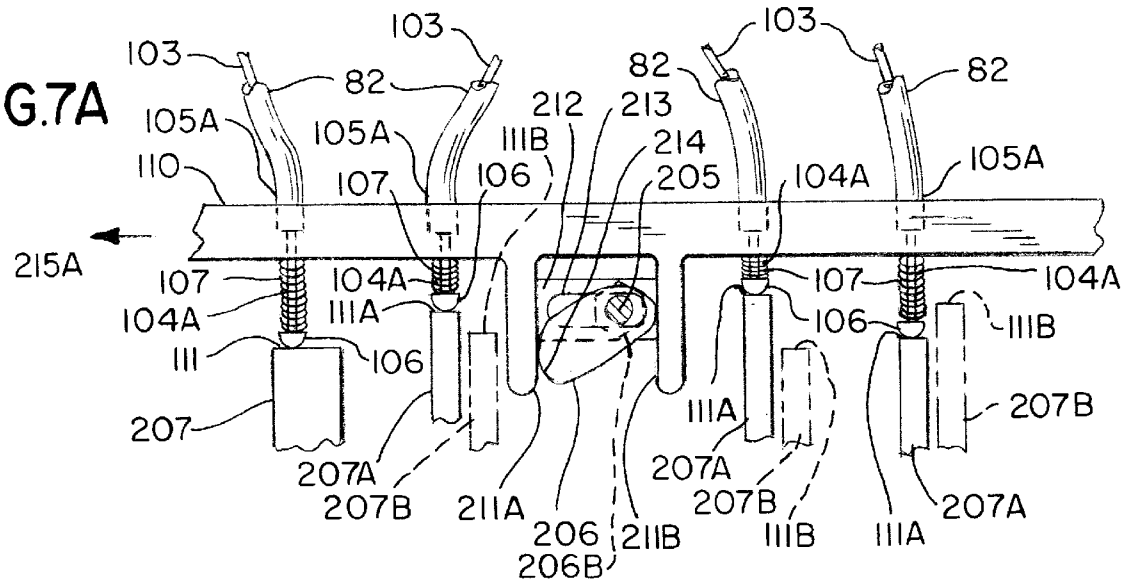
FIG. 7A is an end section view of a portion of the motion control system of FIG. 5.

FIG. 9 shows a side view of the head 24 and a breakout view of eyelid mechanism 180 of the doll 3. The head 24 is pivoted at pivot joint 181 of the torso 34 and is tiltable in a forward direction 182A and in a backward direction 182B, using the sub-miniature push-pull cables 82. The distal end 105B of the flexible hollow housing 102 is, for example, affixed to internal point 183 of the torso 34, and the distal end 104B of the flexible push-pull cable core 103 is affixed to internal connection point 185 of the head 24. The proximal end 104A of the flexible hollow housing 102 is affixed to the cable frame 110, as shown in FIGS. 5, 7A, and 7B. The knob 106 is affixed to the proximal end 104A of the flexible push-pull cable core 103, and is biased abuttingly against the cam profile 111, with the biasing spring 107, imparting curvilinear motion to the head 24 through the flexible push-pull cable core 103, as the knob 106 moves abuttingly against the cam profile 111, and as the tray 113 moves curvilinearly in the forward and backward directions 182A and 182B, respectively.

The eyelid mechanism 180 is weight operated, similar to most baby dolls. However, eyelid motion close and open directions 187A and 187B, respectively of the doll 3 are reversed, compared with most baby dolls. The baby doll generally closes both eyes, when placed lying on the baby doll's back, i.e., with head back. Eyelids 188 move in the open direction 187B, opening the eyes 28 of the doll 3, when the head 24 is tilted backwards, as in the head tilt backwards direction 182B. The eyelids 188 of the doll 3 close over the eyes 28 in the close direction 187A when the head 24 is tilted forward, as in the forward head tilt direction 187A. Since the eyes 28 respond to small motions, the motion of the eyelids 188 are amplified. Both the "amplification" and the eyelid directional motion of the doll 3 having the eyelids 188 close over the eyes 28 when the head 24 is tilted forward, as in the forward head tilt direction 187A, and open when the head 24 is tilted backwards, as in the backward head tilt direction 187B, are accomplished with mating eyelid gear 189 and gear 190. The eyelid gear 189 is smaller than the gear 190, the ratio of the diameters of the gear 190 to the eyelid gear 189, respectively, determining the amount of eyelid amplification smaller. The smaller eyelid gear 189 is affixed to the eyelid 188 and rotates as in the close and open eyelid motion directions 187A and 187B, respectively, over the eye 28. The larger gear 190 is attached to pendulum weight 191, which rotates the gear 190 when the head is tilted in either the direction 182A or the direction 182B. The rotation of the gear 190 in turn rotates the mating eyelid gear 189, which is affixed to the eyelid 188, which opens and closes the eyelid 188 over the eye 28. Back stop 192 and forward stop 193 limit motion of the pendulum weight 191. The back stop 192, the forward stop 193, gear shaft 194 of the smaller gear 189, and gear shaft 195 of the larger gear 190, respectively are affixed to the head 24.

Now in more detail, as shown in FIG. 5, the cam tray 113 of the motion control system 4 has opposing flanges 196 and 197, respectively, mounted to base 198, the extensions 15 of which form the track rails 117 of the cam tray 113. The flanges 196 and 197 have grooves 199 with the cam profiles 111 matingly mounted therein the grooves 199, and grooves 199A and 199B, with the cam profiles 11IA and 111B matingly mounted therein the grooves 199A and 199B and therebetween the opposing flanges 196 and 197. The motor 81 is affixed to the flange 196 by bracket 200, and is powered through flexible insulated cables 201 and 202, connected to opposing terminals of the batteries. The motor 81 drives a shaft having gear 203 mounted thereon, which in turn drives mating gear 204, as power is supplied to the motor 81. The mating gear 204 drives lead screw 205 affixed thereto the mating gear 204. The lead screw 205 provides drive power to mating elongated cam shaped receiving nut 206 mounted thereto the cable frame 110. Since the cable frame 110 is affixed to the track blocks 115, which are affixed to internal portions of the doll 3, the cam tray 113 moves in the directions 114A and 114B, as the lead screw 205 provides drive power to the mating receiving nut 206. The track rails 117 of the cam tray 113 mate with and move within the receiving tracks 116 of the track blocks 115 in the directions 114A and 114B. The motor 81 moves with the cam tray 113, as the cam tray moves in the directions 114A and 114B, while the cable frame 110 remains fixed within the doll 3.

FIG. 5 shows more cams than cables, since each of the cables 82 can be operated by two separate cams 207A and 207B or one cam 207. FIGS. 7A and 7B show end section views of a portion of the motion control system of FIG. 5. The cam tray 113 has the cam 207, having the cam profile 111, and the cams 207A and 207B, having the profiles 111A and 111B, respectively, the cam profile 111 associated with one of the sub-miniature push-pull cables 82, and each pair of the cam profiles 111A and 111B associated with another one of the sub-miniature push-pull cables 82. Each of the cam profiles 111 is, thus, associated with one each of the subminiature push pull cables 82, and each of the cam profiles 111A and 111B are associated with another one of the pus pull cables 82. The cam 207A and the respective cam profile 111A are used during movement of the cam tray 113 in the direction 114A, and the cam 207B and the respective cam profile 111B are used during movement of the cam tray 113 in the direction 114B, while the cam 207 and the cam profile 111 are associated with movement of the cam tray 113 in both the directions 114A and 114B.

Each of the cam profiles 111, 111A and 111B has a different shape, which depends upon the required motion, speed, and direction of each limb, the head 24, and the eyelids 188 of the doll 10. The receiving tracks 116 of the track blocks 115, which are rigidly attached to an internal surface of the torso 34, act as linear bearings for the cam tray 113, and are guided through the receiving tracks 116 in the track blocks 115 by the tracks 117of the cam tray 113 in each of the track blocks 115. The cams 207, 207A, and 207B are linear cams and are shown affixed in the grooves 199 and grooves 199A and 199B of the flanges 196 and 197, respectively.

The cable frame 110 is allowed to shift in position substantially transverse to the directions 114A and 114B of the cam tray 113, as shown in FIG. 5, and is loosely fastened to the track blocks 115. The cable frame 110 has oblong slots 209 transverse to the directions 114A and 114B, having shanks (not shown) of shoulder screws 210 therethrough. The shoulder screws 210 having the shanks inserted therethrough the slots 209 hold the cable frame 110 loosely fastened to the track blocks 115, allowing the cable frame 110 to shift substantially transverse to the directions 114A and 114B of the cam tray 113, the slots 209 shifting about the shanks transverse to the directions 114A and 114B.

The cable frame 110 has flanges 211A and 211B having plate 212 affixed therebetween the flanges 211A and 211B, as shown in FIGS. 7A and 7B. The plate 212 has elongated slot 213 with the lead screw 205 therethrough. The elongated cam shaped receiving nut 206 engages the lead screw 205 with some friction. Depending on the direction of rotation of the lead screw 205, the lead screw 205 shifts within the oblong slot 209, and as the lead screw 205 shifts, end 214 of the elongated cam shaped receiving nut 206 shifts abuttingly from the flange 211A abuttingly to the flange 211B and vice versa; and as the receiving nut 206 shifts, the cable frame 110 moves either in direction 215A or 215B, so that either the cam profile 111A or 111B is selected, respectively. The knob 106 shifts to either the cam profile 111A or 111B, as the cable frame 110 shifts to the end of travel in either the direction 215A or 215B. Another of the knobs 106, however, remains abuttingly in contact with the cam profile 111 in both the directions 215A and 215B. Depending on the direction of rotation of the lead screw 205, the receiving nut 206 or an opposing nut (not shown) on an opposing side of the plate 212 from the receiving nut 206 pushes against the plate 212 and thus pushes the cam tray 113 in either the direction 114A or 114B. The cam tray 113 thus moves in either the direction 114A or 114B, as the lead screw 205 forces either the receiving nut 206 or the opposing nut against the plate 212 adjoined to the flanges 211A and 211B. The cam 207 is substantially as wide as the width of the cams 207A plus 207B plus the space between the cams 207A and 207B, and operates the sub-miniature push-pull cables 82 in the same manner regardless of the shift of cable the frame 110.

It is estimated that the motion control system 4, including attachment of the distal ends of the various cables can be assembled in a manual operation by a single skilled operator in less than 15 minutes. The parts are quite inexpensive and may be of molded parts, tubing, nylon monofilament, a toy motor, and plastic gears or other suitable material. The cams may be molded or die cut from sheet stock, using steel-rule dies or fabricated by another suitable process. The cams 207, 207A and 207B may be identified by number and/or color for assembly or religious denomination.

The need for different types of cams, i.e., the cam 207 and the pair of cams 207A and 207B, each having the different cam profiles 111A and 111B, respectively, for different direction operation is illustrated by a "Catholic" example. It is customary for Catholics to make the sign of the cross before and after praying. The sequence for making the sign of the cross is generally the same, top, bottom, left, right. If a cam is traveling to the right and has the proper sequence, the cam then stops. The prayer is then recited by the prayer doll 2. At the end of the prayer, the cam tray 113 is sent back to the left. If the "sign of the cross" cable actuators are simply actuated by the same cams in reverse, the sign of the cross will be backwards, left, right, bottom, top. Therefore, on the reverse trip, different cams for these two "sign of the cross" actuators must be used, to perform motions in the proper sequence and direction, in this case the cams 207A and 207B, each having the different cam profiles 111A and 111B.

The sub-miniature push-pull cables 82 operate the head 24. The head 24 is bowed; the prayer is recited; the head 24 is "unbowed." Since this is substantially "bowing" and "unbowing," each of which are substantially the reversal of one from the other, the single wide cam 207 is used, as shown in FIGS. 7A and 7B.

Therefore, depending upon the limbs and/or the body parts to be moved, and the type of motion to be imparted to the limbs and/or the body parts, either a pair of the cams, as in the cams 207A and 207B or one of the cams, as in the cam 207, is used. It is also obvious that more cams may also be used for more complex motions. In such cases, the knob 106, associated with one of the push-pull cables 82, may shift from the cam 207A to the cam 207B to additional cams, such as cams 207C, 2007D, and so on, so that a different set of movements can be achieved, after the doll 3 returns to the starting position, and starts another cycle of movements.

Since the motion control system 4 and electronics system 5 of the prayer doll 2 may be used for other doll types, the above described feature is even more important, providing the ability for a sequence of actions at the start with a different sequence at the end. For example, consider a "Famous Leaders" series of talking dolls having a repertoire of movements and a repertoire of audio messages, such as "Reverend Martin Luther King" giving an address or a "General MacArthur" giving a speech. The Reverend, for example, may give salutary gestures, give a speech and/or recite prayers, and have different closing gestures. The General, for example, may salute, put his hands on his hips in an assertive posture, address the "crowd", and then raise and wave his right arm acknowledging the "crowd" reaction before returning to the starting posture.

Typically, the subminiature motor 81 may have an output of approximately 10,000 rpm, with a 10:1 gear speed reduction from the motor drive shaft gear 203 to the mating gear 204, the lead screw 205 typically having an 8–32 fastener thread, and the cam tray 113 typically having a 3 inch linear excursion.

FIG. 10 shows a schematic diagram of the electronics system 5 of the prayer doll 2, in accordance with the present invention. Prayer action, i.e., motion and speech, is started by depressing momentary pushbutton switch S1. A battery B1, comprising four "C" size alkaline cells provides a nominal 6 volts to n-channel MOSFET Q1 and resistor R1 of logic modules R1/C1, when the momentary pushbutton switch S1 is depressed, resulting in a rising voltage, having a time constant of approximately 3 seconds, supplied to the input of inverter I1. The inverter I1 provides an inverted output voltage to the input of inverter 12, which resets J–K flip-flops FF1 and FF2. The Flip flop FF1 output "not Q" turns gate input G of the MOSFET Q1 high, which turns the MOSFET Q1 on, thus powering the electronic system 4 through the MOSFET Q1, even after a user's finger is removed from the switch S1. The flip flop FF2 sets the directional input of half bridges HB1 and HB2, such that the miniature motor 81 is set for the correct start-up direction. Resistors R3 and R4 are logic pull-up resistors, while resistors R5 and R7 are pull-down resistors.

At startup, the cam tray 113 is directed maximally in the direction 114B (i.e. at the left, as shown in FIG. 5), with limit switch LS1 having been tripped, thus interrupting contact to terminal NC1 of the limit switch LS1.

At startup, the initial high signal at the output of inverter I1, which has a typical duration of approximately 2 seconds, is transmitted through NOR gate NOR1 to enable the half bridge HB1 for a long enough duration for the cam tray 113 to deactivate the limit switch LS1, which then maintains the half bridge HB1 enabled. The half bridge HB2 is enabled through terminal NC2 of limit switch LS2. Both the half bridges HB1 and HB2 must be enabled in order to provide power to the miniature motor 81, and therefore enable the cam tray 113 to move.

The entire excursion of the cam tray 113 from the maximal limit in the direction 114B to the maximal limit in the direction 114A (i.e. from left to right, as shown in FIG. 5), or vice-versa, from the maximal limit in the direction 114A to the maximal limit in the direction 114B, is takes typically 4 to 5 seconds.

The cam tray 113 continues to move until the half bridge HB2 is disabled by the limit switch LS2. The subminiature motor 81 stops rotation of the shaft the having gear 203, and the limit switch LS2 causes the clock of the flip flop FF2 to have minimum output, which reverses the voltage to the subminiature motor 81, which then reverses rotation of the motor drive shaft gear 203, the mating gear 204, the lead screw 205, and the direction of travel of the cam tray 113.

The electronics system 5 has playback subsystem PBS, shown in FIG. 10, to deliver audio messages. The limit switch LS2 signals the playback system PBS through input line P/E to start playing an audio message or prayer, when the cam tray 113 contacts the limit switch LS2. The playback subsystem PBS then transmits audio output to loudspeaker LS. At the end of the audio message or prayer, an end of message signal EOM, sent to capacitor C2 though blocking resistor R8, charges the capacitor C2 through the blocking resistor R8, and enables the half bridge HB2 long enough for the cam tray 113 to start moving in the direction 114A (i.e. to the left, as shown in FIG. 4) and enable the half bridge HB2 through the limit switch LS2, so that the cam tray 113 continues to move in the direction 114A.

The subminiature motor 81 continues to rotate the shaft having the gear 203, until the cam tray 113 actuates the limit switch LS1, and the cam tray has returned to the initial starting position maximally in the direction 114B (i.e. at the left, as shown in FIG. 5). In addition to stopping subminiature motor 81, the limit switch LS1 actuates the clock input CK of flip flop FF1 through inverter 13, which sets the flip flop FF1, and which, in turn, deactivates the MOSFET Q1, which then shuts the electronics system 5 down, except for negligible leakage through the MOSFET Q1. The inverters I1, I2, and 13 as well as the NOR gate NOR1 may be derived from a single suitable logic module, such as an MC74HC02A CMOS logic module, or another suitable or substantially equivalent logic module. The flip flops FF1 and FF2 may be derived from a single suitable flip flop, such as an MC74HC107 CMOS module, or another suitable or substantially equivalent module. The half bridges HB1 and HB2 may be derived by suitable biasing of a single suitable bridge, such as an L293 Half-H driver module, or another suitable or substantially equivalent bridge or driver module. For applications other than the prayer doll 2, but substantially similar to the prayer doll 2, the return motion of the cam tray 113 can be started before the audio message or prayer ends, by encoding the audio message or prayer into two separate messages and/or prayers, with the first end of message signal EOM starting the return motion. An 8-bit microprocessor other suitable microprocessor may be used to support additional and/or other activities, using substantially the same or similar basic mechanisms with additional suitable sensors. Suitable Read Only Memory (ROM) may also be used for audio.

The playback subsystem PBS may be of a suitable single ChipCorder module, or other suitable record-playback module or substantially similar device. Such modules have complete audio record and playback electronics, with sampled analog storage in a single module. A single such module may drive the loudspeaker LS directly, and may be selected having storage times typically from 6 seconds to 4 minutes. A typical module, such as ISD module ISD 33075, or other suitable or equivalent module can, for example, store 75 seconds of audio. Other suitable or equivalent modules may also be used for the record-playback function.

Using a doll-mounted receiving connector CM, having male pins, allows different keyed prayer modules 254A, 254B, 254C, and 254D, having different pre-recorded prayers for different religious denominations, and each of the different keyed prayer modules 254A, 254B, 254C, and 254D having mating connectors CN, having female contacts, shown in FIG. 11, to be matingly connected thereto the connector doll-mounted receiving connector CM. Since the interfaces of most ISD modules, for example, are substantially the same, different ISD modules that approximates audio message duration commensurate with the length of selected prayer messages for different religious denominations may be used to reduce cost.

Each of the prayer modules is constructed with a keyed body that only fits the doll of the particular denomination for which the prayer is designed. FIGS. 11A–11D show key shapes, which may be used for the prayer modules 254A, 254B, 254C, and 254D, and which may be used for different religious denominations, respectively, although other suitable key shapes and designs may be used, as well. Each of the prayer modules 254A, 254B, 254C, and 254D has a multi-contact connector, which mates with pins in the mating connector CM, which is mounted in the doll 3, and which is accessed through a compatible keyway. The prayer module 254A may, for example, be used for the "Catholic" religious denomination. FIG. 11E shows a prayer module in the shape of the prayer module 254A that holds a "Catholic" prayer, such as the "Hail Mary." Other suitable key shapes may alternatively be used, and/or used as well.

Various components can be placed in a variety of doll locations. For a prayer doll 2, such as, for example, of substantially 18 inch (46 cm) or 24 inch (61 cm) lengths, the recommended locations for system and/or component placement are the torso 34 for the motion control system 4 and the electronics system 12, including the loudspeaker LS of the playback subsystem PBS. The battery B1 may comprise four "C" cell batteries or other suitable batteries, which may be located in the legs, one each of the "C" cells in each of the thighs, and one each of the "C" cells in each calf of the lower leg, which adds weight to the legs for stability. Additional weight in terms of sand fill or other suitable material may also be added to the legs and feet for additional stability. The switch, as well as battery compartments, may be hidden by doll clothing, and accessible therethrough the clothing. The doll clothing may be fastened with hook and loop fasteners for easy accessibility of the switch and battery compartments, as required.

FIG. 12 shows an alternate embodiment of a prayer doll 301, which has the ability to automatically kneel from a standing position 302A, through intermediate position 302B, into kneeling position 302C, and after kneeling, return to the standing position 302A. The prayer doll 301 automatically kneels, recites a prayer, and automatically moves limbs and body parts as in the prayer doll 2. After the prayer doll 301 recites the prayer, the prayer doll 301 automatically returns to the standing position. The prayer doll 301 has a doll 303 having moving moveable body parts, a motion control system 304 having a kneeling subsystem, having leg kneeling subsystem portion 304A within legs 305, base kneeling subsystem portion 304B within base 306, and a doll motion control system portion 304C within the doll 303, an electronics system 307 having a base electronics system portion 307A, and a doll electronics system portion 307B, and the base 306.

Observing how a human kneels from a standing position, or how a human stands from a kneeling position without leaning on an adjacent object, or returns from one or the other to the other, it is obvious that it is quite complex for the human to maintain balance. Usually, one foot is moved relative to the other, and often, arms and torso are moved to maintain balance. While computer techniques with tilt sensors and/or accelerometers can be used in a closed-loop servo control system to mimic these human motions for a prayer doll, such a system would be too costly to satisfy the need for an inexpensive prayer doll.

The doll 303 of the prayer doll 301 is substantially the same as the doll 3 of the prayer doll 2, except that the doll 303 may be removably affixed to tiltable foot platform 308 of the base 306 at doll feet 309, and has the kneeling subsystem having the leg kneeling subsystem portion 304A and the base kneeling subsystem portion 304B, which allows automatic kneeling motion of the doll 303, when the doll 303 is removably affixed to the tiltable foot platform 308 at the feet 309. The doll 303 can be easily detached from the tiltable foot platform 308 for storage or play activities. The kneeling subsystem having the leg kneeling subsystem portion 304A and the base kneeling subsystem portion 304B is part of the motion control system 304. The leg kneeling subsystem portion 304A of the kneeling subsystem is housed within the legs 305, and the base kneeling subsystem portion 304B of the kneeling subsystem is housed within the base 306 of the doll 303.

The motion and sound repertoires of the prayer doll 301 are implemented in substantially the same manner as in the prayer doll 2, except that the prayer doll 301 also has actuator wires, which function as artificial muscles, and which contract and expand when heated and cooled, respectively, as well as a linear cam system as in the prayer doll 2.

The prayer doll 301 is capable of standing to kneeling motion and vice versa, without loss of balance or toppling. The mechanism is simple, direct and inexpensive. Motive power for the kneeling and standing operations is provided electrically by lengths of actuator wire, such as nickel-titanium (Ni—Ti) wire, which has the property of contracting more than 5 per cent, when heated above a transition temperature. Such wire is available from a variety of sources and in various gages. Typical nickel-titanium (Ni—Ti) wire is available as "Flexinol" from Dynalloy, Inc. of Irvine, Calif., although other suitable materials or materials having substantially similar properties may be used for the actuator wires. The actuator wires function as artificial muscles, which contract and expand when heated and cooled, respectively.

FIG. 12 shows a side cross section view of the doll 303 and the base 306, showing the leg kneeling subsystem portion 304A and the base kneeling subsystem portion 304B. The tiltable foot platform 308 has side rails 313, which engage the feet 309, and thus affix the feet 309 to the tiltable foot platform 308. The tiltable foot platform 308 is pivoted at pivot 315. End 316 of tiltable foot platform actuator wire 317, which is threaded around pulley 318, is affixed to the base 306 within the base 306 at connection point 320, while opposing end 321 of the tiltable foot platform actuator wire 317 is affixed to the tiltable foot platform 308 at connection point 323. The tiltable foot platform 308 tilts when electric current is passed through the tiltable foot platform actuator wire 317, which is threaded around the pulley 318, and the tiltable foot platform actuator wire 317 contracts. As electric current is passed through the tiltable foot platform actuator wire 317, the tiltable foot platform actuator wire 317 is heated, and the tiltable foot platform actuator wire 317 contracts in a smooth fashion. The rate of contraction of the tiltable foot platform actuator wire 317 depends upon the current applied to the tiltable platform actuator wire 317, and the resultant heating of the tiltable platform actuator wire 317. As the tiltable foot platform actuator wire 317 contracts, the tiltable foot platform actuator wire 317 pulls the tiltable foot platform 308 at the connection point 323, rotationally tilting the tiltable foot platform 308 (counterclockwise as shown in FIG. 12) about pivot 315 from a starting position. Upon cooling, spring 325 restores the tiltable foot platform 308 to the starting position. Opposing ends 326A and 326B of the spring 325 are affixed to the base 306 at connection point 327A and the tiltable foot platform 308 at connection point 327B, respectively.

The electronics system 307 has the base electronics system portion 307A housed within the base 306, and has circuits for control of the tiltable foot platform 308. The battery B1 has "C" cell batteries 329 in battery holder 329A, which provide power to the base electronics system portion 307A. Momentary pushbutton switch 329 initiates activity of the prayer doll 301. Since larger batteries or more batteries may be used for additional power in the prayer doll 301, as compared to the prayer doll 2, batteries may be contained in the base 306 and/or in the doll 30, and power the doll electronics system portion 307B of the prayer doll 301.

The doll 303 is shown in FIG. 12: in a standing position 302A; in an intermediate position 302B, as an outline view; and in a kneeling position 302C, as an outline view. Relative positions of doll thigh 331, torso 332, and buttocks 333 remain substantially the same, one to the other, and substantially angularly the same, in all three positions, 302A, 302B, and 302C. Pivot 335 allows such substantially similar relative positions of the thigh 331, the torso 332, and the buttocks 333 one to the other and substantially angularly the same relative positions of the thigh 331, the torso 332, and the buttocks 333 one to the other, as the doll 303 is in and transitions between the positions 302A, 302B, and 302C, as determined by the motion control system 304.

Knee joint pivot 336 aids in the kneeling action. Knee joint actuator wire 338 bends knee 339, when the knee joint actuator wire 338 is heated, and the knee joint actuator wire 338 contracts. End 340 of the knee joint actuator wire 338 is affixed internally to the thigh 331 at connection point 342, the knee joint actuator wire 338 is threaded around pulley 346, and opposing end 348 of the knee joint actuator wire 338 is affixed to lower leg 349 at connection point 350. The knee joint actuator wire 338 acts as a hamstring muscle, and return spring 351 having ends 352A and 352B connected internally to the thigh 331 at connection point 353A and to the lower leg 349 at connection point 353B, respectively, acts as antagonist quadriceps muscle. Bending motion may be amplified with the use of additional pulleys, which permits the use of a longer knee joint actuator wire 338 than with one pulley alone, and increases the length of stroke of the "hamstring muscle" knee joint actuator wire 338. Right leg (not shown) is substantially similar to the left leg.

The tiltable foot platform actuator wire 317 and the knee joint actuator wires 338 are energized substantially at the same time. Since heating of the tiltable foot platform actuator wire 317 and the knee joint actuator wires 338 occurs over a short time, but does not occur instantaneously, the transition from standing to kneeling takes place in a smooth fashion; and the transition is silent, with the angle of the lower leg 349 changing from a substantially upright position through an intermediate position to a substantially horizontal position, as the doll 303 moves from the standing position 302A through the intermediate position 302B to the kneeling position 302C. Momentary switch 358 is affixed to one of the knees 339 and senses when the kneeling motion is over. The momentary switch 358 may supplement or replace the momentary push button switch S1 as described for the prayer doll 2, and start the motion control system the motion control system 304, which operates the prayer doll 301 functions, as in the prayer doll 2.

FIG. 13 shows a bottom view of the feet 309 of the doll 303, having metallic contacts 361 . . . 363. FIG. 14 is a block diagram of the base electronics system portion 307B of the prayer doll 301. The contacts 361 . . . 363 are in registration with mating spring contacts (not shown) on the tiltable foot platform 307. The contacts 361 supply electric current to a series combination of the left and right knee joint actuator wires 338. The contacts 362 supply power to the motion control system 304 and the electronics system 307, shown in FIG. 14 as 304 and 307, respectively. The contacts 363 connect to terminals of switch SS, also shown in FIG. 14, which senses that the cam is in or has returned to the starting position.

FIG. 14 shows the base electronics system portion 307A. Power controller PC starts the kneeling action, when momentary push button switch 329 is depressed, and power is supplied to the kneeling subsystem. Start timer ST counts off a time interval of substantially one second or less. Free-running multivibrator MV starts running at a high frequency setting and is switched to a lower frequency setting at the end of the ST time interval. Single-shot SS emits a substantially fixed duration pulse for each pulse received from the multivibrator MV. Power driver PD supplies current to the series combination of the "hamstring" left and right knee joint actuator wires 338, having electrical resistances R338A and R338B, respectively, shown in FIG. 14, and the tiltable foot platform actuator wire 317, having electrical resistance R317A, also shown in FIG. 14, during each pulse received from the single-shot SS. The frequency of the multivibrator MV determines the duty cycle and hence the electrical heating power supplied to the tiltable foot platform actuator wire 317 and the knee joint actuator wires 338.

At the start of the kneeling action, the tiltable foot platform actuator wire 317 and the knee joint actuator wires 338 wires are at ambient temperature. As the frequency of the multivibrator MV is increased, additional power is applied to the tiltable foot platform actuator wire 317 and the knee joint actuator wires 338, which increases the temperature of the tiltable foot platform actuator wire 317 and the knee joint actuator wires 338, causing the tiltable foot platform actuator wire 317 and the knee joint actuator wires 338 to contract, and the doll 303 to move from the starting position 302A through the intermediate position 302B to the kneeling position 302C.

After the kneeling position 302C is achieved, less power is required to maintain actuator wire temperature, and battery power consumption is decreased, by decreasing the frequency of the multivibrator MV, which reduces the power applied to the tiltable foot platform actuator wire 317 and the knee joint actuator wires 338. Switch S5 (not shown in FIG. 12) of the prayer doll 301 is placed near limit switch LS2 (not shown in FIG. 12) of the doll motion control system portion 304C, which is open at the start position of the cam tray (not shown in FIG. 12) of the doll motion control system portion 304C of the prayer doll 301. A falling signal edge from single-shot SS causes the power controller PC to shut down at the end of the prayer, after limb and body motion has substantially stopped. The tiltable foot platform actuator wire 317 and the knee joint actuator wires 338 cool down and elongate from the contracted lengths, permitting the "antagonistic" return springs 351 and the spring 325 to return the prayer doll 301 to the standing position.

The prayer doll 301 has a playback system, as in the prayer doll 2. Audio prayer is recited by the prayer doll 301 in substantially the same manner as in the prayer doll 2.

Although the present invention has been described in considerable detail with reference to certain preferred versions thereof, other versions are possible. Therefore, the spirit and scope of the appended claims should not be limited to the description of the preferred versions contained herein.

What is claimed is:

1. A prayer doll, comprising:

a doll comprising at least one moveable component; and a motion control system comprising:

at least one cam;

drive means adapted to drive said at least one cam;

at least one cam follower;

said at least one cam follower adapted to abut said at least one cam;

at least one push pull cable having a first end and a second end;

said at least one push pull cable first end adjoined thereto said at least one cam follower, said at least one push pull cable second end driving said at least one moveable component.

2. The prayer doll according to claim 1, wherein said prayer doll has an audio playback system.

3. The prayer doll according to claim 2, wherein said motion control system is adapted to impart at least one simulated prayer related motion to said prayer doll, and said audio playback system is adapted to simulate at least one prayer related sound.

4. The prayer doll according to claim 3, wherein said audio playback system has at least one plug in removably replaceable module, said at least one plug in removably replaceable module keyed to at least one religion or religious denomination.

5. The prayer doll according to claim 1, wherein said motion control system is adapted to impart at least one simulated prayer related motion to said prayer doll.

6. The prayer doll according to claim 1, wherein said dive means comprises a motor.

7. The prayer doll according to claim 1, wherein said at least one cam is mounted on a moveable platform.

8. The prayer doll according to claim 7, wherein said moveable platform is moveably mounted on at least one track.

9. The prayer doll according to claim 7, wherein said drive means is adapted to impart motion, comprising direction of travel, to said moveable platform, wherein said direction of travel is reversible.

10. The prayer doll according to claim 9, wherein said direction of travel is controllable.

11. The prayer doll according to claim 7, wherein said moveable platform comprises a substantially planar shaped platform.

12. The prayer doll according to claim 7, wherein said drive means is adapted to impart substantially linear motion to said moveable platform.

13. The prayer doll according to claim 7, wherein said drive means is adapted to drive said moveable platform.

14. The prayer doll according to claim 7, wherein:

said at least one cam comprises at least one first cam and at least one second cam;

said drive means is adapted to impart a first motion and a second motion to:

said moveable platform, said at least one first cam, and said at least one second cam;

said at least one cam follower adapted to abut said at least one first cam, during said first motion; and said at least one cam follower adapted to abut said at least one second during said second motion.

15. The prayer doll according to claim 14, wherein:

said first motion comprises a first direction;

said second motion comprises a second direction;

said motion control system further comprises means for selecting said at least one first cam and said at least one second cam, for said at least one cam follower to abut therewith, according to said first direction and said second direction.

16. The prayer doll according to claim 1, wherein said drive means is adapted to impart at least one substantially linear motion to said at least one cam.

17. The prayer doll according to claim 1, wherein said at least one cam follower is spring loaded.

18. The prayer doll according to claim 1, wherein said at least one push pull cable second end is adjoined thereto said at least one moveable component.

19. The prayer doll according to claim 1, wherein said at least one push pull cable second end is adjoined thereto at least one actuator, said at least one actuator abutting said at least one moveable component.

20. The prayer doll according to claim 1, wherein:

said at least one can comprises at least one first cam and at least one second cam;

said drive means is adapted to impart a first motion to said at least one first cam and a second motion to said at least one second cam;

said at least one cam follower adapted to abut said at least one first cam, during said first motion; and said at least one cam follower adapted to abut said at least one second cam, during said second motion.

21. The prayer doll according to claim 1, wherein:

said drive means is adapted to impart a first motion and a second motion to said at least one cam;

said at least one cam follower adapted to abut said at least one cam, during said first motion and said second motion.

22. The prayer doll according to claim 1, wherein:

said at least one cam comprises a profile;

said at least one driven cam imparts motion to said at least one cam follower, in accordance with said at least one cam profile;

said at least one cam follower motion imparted to said at least one push pull cable;

said at least one push pull cable motion imparted to said at least one moveable component.

23. The prayer doll according to claim 1, wherein:

said drive means is adapted to impart a first motion and a second motion to said at least one cam;

said at least one cam comprises at least one first cam and at least one second cam;

said motion control system further comprises means for selecting said at least one first cam and said at least one second cam, according to said first motion and said second motion.

24. The prayer doll according to claim 1, wherein:

said at least one moveable component is from the group consisting of at least one: head, limb, arm, leg, hand, foot, eye, eyelid, mechanism, and mechanism comprising a combination of at least two thereof.

25. The prayer doll according to claim 1, wherein:

said doll further comprises a torso; and said at last one moveable component is pivotally mounted to said torso.

* * * * *